US006009915A

United States Patent [19]

Schaich et al.

[11] Patent Number: 6,009,915

[45] Date of Patent: Jan. 4, 2000

[54] METHOD AND DISTRIBUTION APPARATUS FOR PNEUMATIC WEFT INSERTION IN A SERIES SHED LOOM

[75] Inventors: Urs Schaich, Eschenbach; Marcel Christe, Rüti, both of Switzerland

[73] Assignee: Sulzer Rueti AG, Rueti, Switzerland

[21] Appl. No.: 09/170,958

[22] Filed: Oct. 13, 1998

[30] Foreign Application Priority Data

Nov. 28, 1997 [EP] European Pat. Off. ..... 97810928

[51] Int. Cl.[7] ..... D03D 47/34; D03D 47/30; D03D 47/00; D03D 47/26

[52] U.S. Cl. ..... 139/28; 139/435.1; 139/194

[58] Field of Search ..... 139/28, 435.3, 139/435.1, 194, 450

[56] References Cited

U.S. PATENT DOCUMENTS

| | | | |
|---|---|---|---|
| 3,962,224 | 12/1975 | Vemeulen et al. | 139/435.1 |
| 4,351,369 | 9/1982 | Arakawa . | |
| 4,637,229 | 1/1987 | Taylor | 139/450 |
| 5,146,955 | 9/1992 | Steiner et al. | 139/450 |
| 5,423,355 | 6/1995 | Greger et al. | 139/450 |
| 5,632,308 | 5/1997 | Bucher et al. | 139/450 |

FOREIGN PATENT DOCUMENTS

| | | |
|---|---|---|
| 0143119A1 | 6/1985 | European Pat. Off. . |
| 0155432A1 | 9/1985 | European Pat. Off. . |
| 0433216A1 | 6/1991 | European Pat. Off. . |
| 2 388 909 | 11/1978 | France . |
| 7611646 | 4/1978 | Netherlands . |
| WO 96/38612 | 12/1996 | WIPO . |

*Primary Examiner*—Andy Falik
*Attorney, Agent, or Firm*—Townsend and Townsend and Crew LLP

[57] ABSTRACT

Lengths of weft thread are sequentially inserted in sheds formed by a series shed weaving machine. Weft thread is continuously supplied with a fluid flow. By reversing the flow direction of the fluid flow or deflecting the weft thread, a thread loop is formed outside a weft distribution apparatus of the weaving machine so that the weft thread remains taut inside the weft thread distribution apparatus. A nozzle arrangement in which the fluid flow direction is reversible or a weft thread clamping and deflecting arrangement are used to form the loop and maintain the weft thread taut.

19 Claims, 2 Drawing Sheets

1
11
31
32
33
34
41
42
5
6
7
15
51
52
53

METHOD AND DISTRIBUTION APPARATUS FOR PNEUMATIC WEFT INSERTION IN A SERIES SHED LOOM

BACKGROUND OF THE INVENTION

The invention relates to a method and to an apparatus for the insertion of a weft thread into a series shed weaving machine with an insertion nozzle and a weft thread distribution apparatus, with the weft thread being continuously fed in by means of a fluid flow and being inserted into successive sheds, and to an apparatus for carrying out the method using a feed-in nozzle and an insertion nozzle and a weft thread distribution apparatus.

In series shed weaving machines the weft threads are inserted by means of a weft thread distribution apparatus. An apparatus of this kind is described in WO 96/38612. In this apparatus a weft thread is introduced by means of a continuous air flow into a connection passage between the weaving rotor and the ring part and inserted via a shoot-in tube into the shed. A severing apparatus and a clamp are placed after the shoot-in tube. Immediately after the arresting of the weft thread by the clamp, a loop is formed in the connection passage as a result of the continuous supply of yarn and is stretched or tautened after the severing of the weft thread.

As the weft thread insertion or speed of rotation of the weaving machine increases, the loop in the connection passage becomes longer and kinks arise, which can lead to congestion and weft faults. In order to improve the undoing of the loops, air can be blown into the connection passage under high pressure by means of an injection nozzle.

SUMMARY OF THE INVENTION

It is an object of the present invention to provide an improved method and apparatus for the insertion of a weft thread into a series shed weaving machine.

The advantages which can be achieved with the invention are to be seen essentially in that the thread loop is produced outside the weft thread distribution apparatus and is thus controllable or adjustable, in that the insertion capacity can be increased, and in that the insertion is done at a uniform fluid pressure.

The invention will be explained in the following with reference to the accompanying drawings.

DESCRIPTION OF THE PREFERRED EMBODIMENTS

Figures 1, 2:
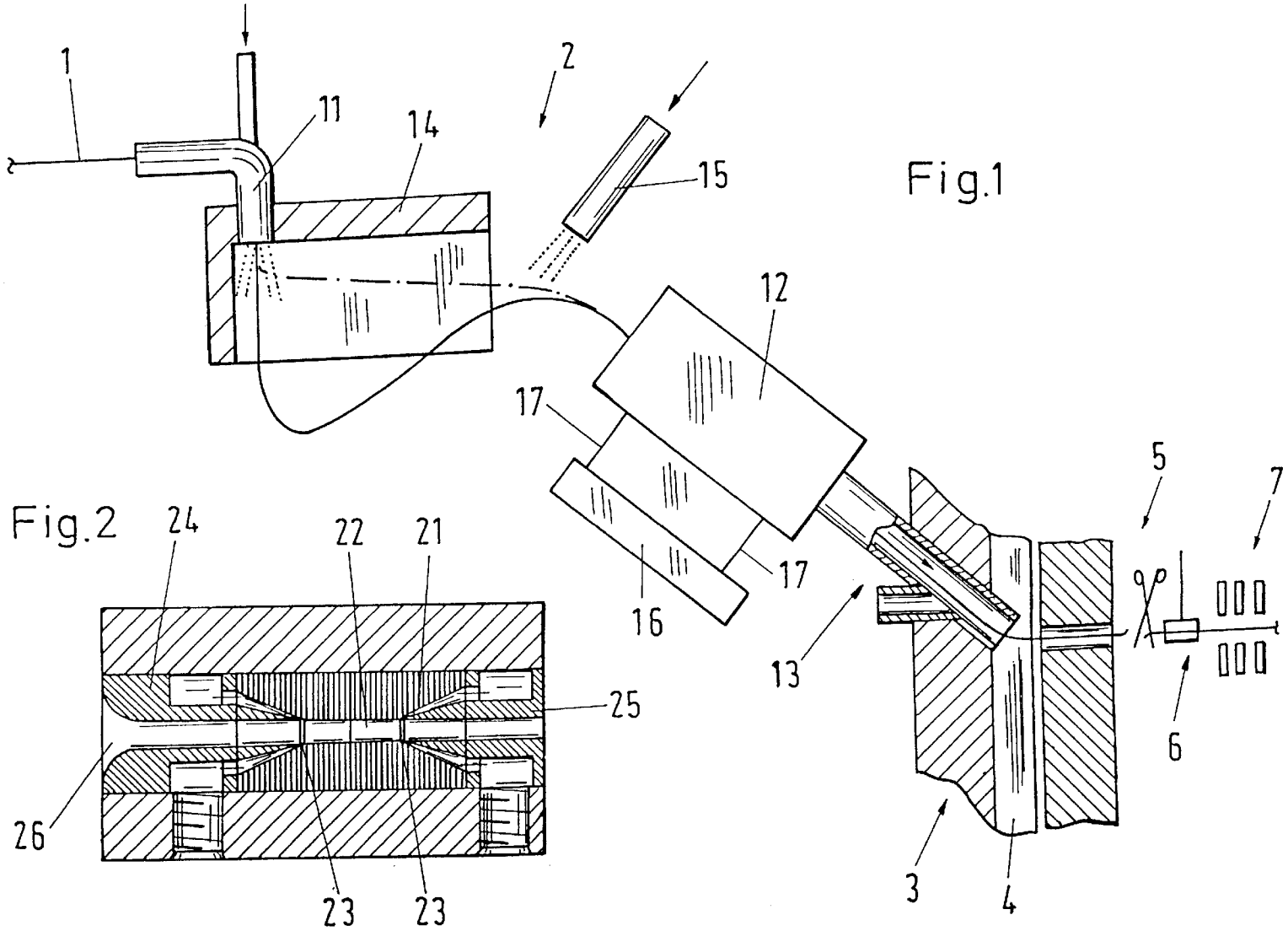
FIG. 1 shows a first embodiment of an apparatus in accordance with the invention for the insertion of a weft thread.
FIG. 2 shows a nozzle arrangement in section.

Reference is made to FIGS. 1 and 2. Starting from a thread storage, a weft thread 1 is introduced into a weft thread distribution apparatus 3 via a metering apparatus and the weft thread insertion apparatus 2 under discussion here and then inserted past a severing apparatus 5 and a thread clamp 6 into a shed which is formed on a weaving rotor 7. The weft thread insertion apparatus comprises a feed-in nozzle 11, a nozzle arrangement 12 and an insertion nozzle 13 which is arranged in the weft thread distribution apparatus 3. Furthermore, a guide member 14 and an auxiliary nozzle 15 are associated with the insertion apparatus. The nozzle arrangement 12 is connected with a rotary slide valve 16 via lines 17 to the compressed air system of the weaving machine.

As shown in FIG. 2 the nozzle arrangement 12 has a body 21 with a passage hole 22 and two seat surfaces 23 and two nozzle needles 24, 25 which are arranged in such a manner that the openings are oriented towards one another. The nozzle needles are formed as hollow needles so that a through-going forwarding passage for a weft thread is present in the nozzle arrangement. An inlet funnel 26 for the weft thread is formed at the one nozzle needle 24, while the other nozzle needle 25 is directly connected to the insertion nozzle 13 in the weft thread distribution apparatus 3.

In the following a method for the insertion of a weft thread by means of the above described-apparatus is explained.

The weft thread 1 is continuously drawn off from the metering apparatus by means of the feed-in nozzle 11 and introduced into the nozzle needle 24. At this time point compressed air is supplied to the nozzle arrangement through the line 17 as a result of the setting of the rotary slide valve 16 so that an air flow is produced in the through-bore 22 which seizes the weft thread and forwards it to the insertion nozzle 13. The weft thread is then shot into the shed and forwarded through the shed in a known manner by means of the travelling field produced by the relay nozzles. Prior to the beginning of the clamping process the reversal of the air flow in the nozzle arrangement 12 is effected by the rotary slide valve so that a thread drawing force is produced in the direction opposite to the forwarding direction. As a result of the thread drawing forces produced by the insertion nozzle and the travelling field, the weft thread continues to be inserted into the shed. Once the weft thread is clamped, the force component of the travelling field is cancelled so that the thread drawing forces produced by the insertion nozzle in the forwarding direction and the nozzle arrangement in the opposite direction cancel, i.e. the forwarding of the weft thread into the shed is interrupted. As a result of this interruption and of the continuous supply of weft thread from the feed-in nozzle 11 a thread loop is produced between the feed-in nozzle 11 and the nozzle arrangement 12. After the clamping the weft thread is severed and blown into the connection passage 4 with the help of the injector nozzle and the weft thread end is substantially extended and held ready for the insertion into the weft thread distribution apparatus 3. By means of the rotary slide valve 16 the flow direction in the nozzle arrangement 12 is again reversed so that the thread loop is undone and the weft thread is inserted into the next shed.

Figures 3, 4, 5:
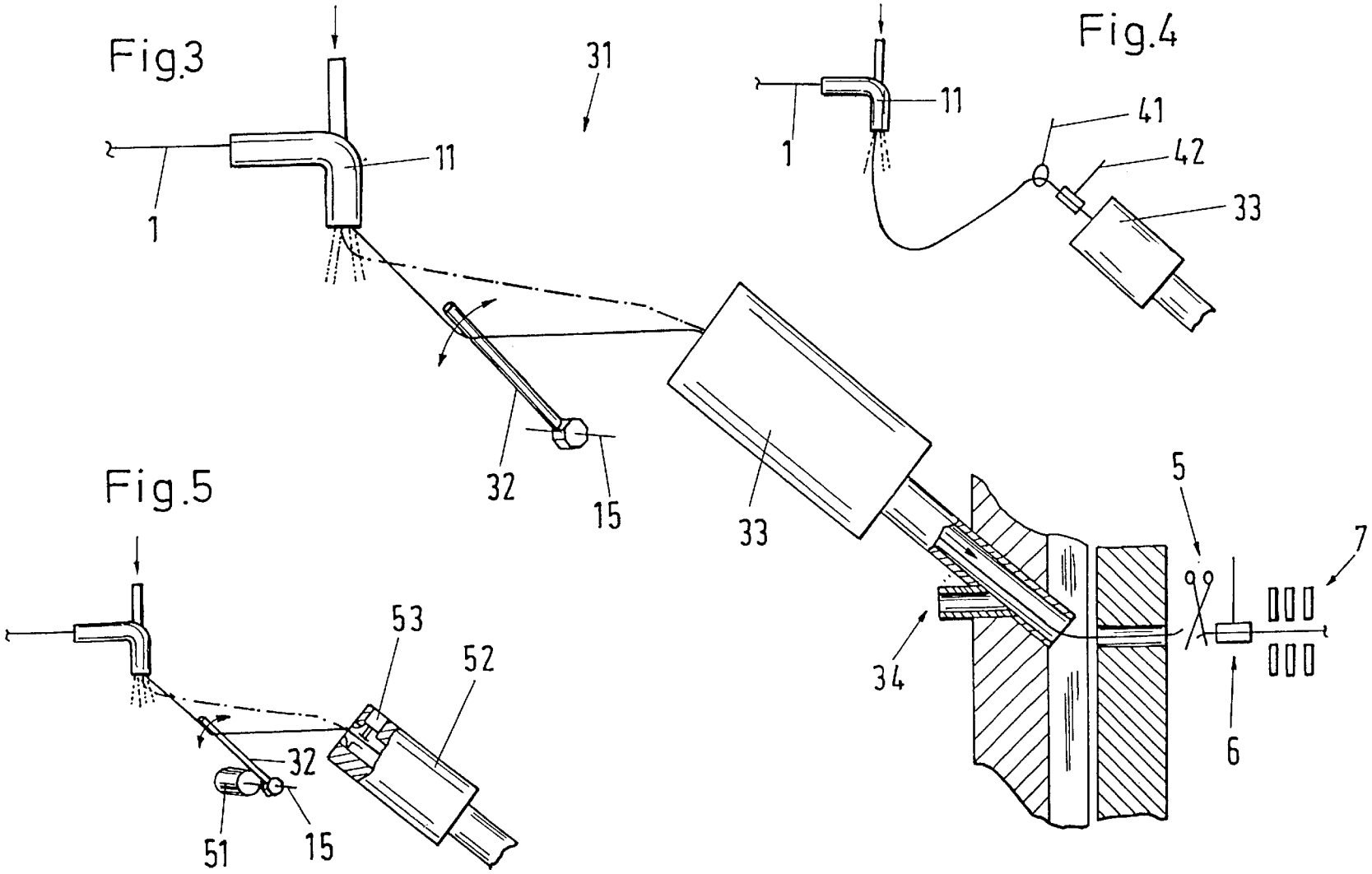
FIG. 3 shows a second embodiment of an apparatus made in accordance with the invention for the insertion of a weft thread.
FIG. 4 shows a third embodiment of an apparatus made in accordance with the invention for the insertion of a weft thread.
FIG. 5 shows a fourth embodiment of an apparatus in accordance with the invention for the insertion of a weft thread.

Reference is made to FIGS. 3 to 5, with the weft thread travelling as in the above-described first embodiment. The weft thread insertion apparatus 31 comprises the feed-in nozzle 11, a deflection member 32, an insertion nozzle 33 and an auxiliary nozzle 34. The deflection member 32 is formed in the shape of a bar and arranged to be pivotal about an axis of rotation 35.

In the embodiment of FIG. 4 a guide member 41 and a thread clamp 42 are provided in contrast to the embodiment of FIG. 3.

In the embodiment of FIG. 5 a drive element 51 for the deflection member 32 and an insertion nozzle 52 is provided as well as a thread clamp 53 which is integrated into the body of the insertion nozzle.

In the following the method for the insertion of a weft thread by means of the apparatus in accordance with FIGS. 3 to 5 will be explained.

The weft thread 1 is continuously drawn off from the metering apparatus by means of the feed-in nozzle 11 and introduced past the deflection member 32 into the insertion nozzle 33. At this point in time compressed air is supplied to the insertion nozzle and the weft thread is shot into the shed. The weft thread is then forwarded through the shed in a known manner by means of the relay nozzles. With the actuation of the thread clamp 6 the weft thread is held and the forwarding of the weft thread into the shed is interrupted. As a result of this interruption and of the continuous supply of weft thread from the feed-in nozzle, a thread loop is produced between the feed-in nozzle 11 and the insertion nozzle 33 through positive deflection by means of the deflection member. After the clamping the weft thread is severed by means of the severing apparatus 5 and the thread ends formed are blown by the air flow into the connection passage 4. The force exerted by the air flow on the weft thread acts, on the one hand, as a restraining force with respect to the formation of a loop and, on the other hand, as a stretching or tautening force for the thread end. Through the release of the weft thread by means of the deflection member, the weft thread is inserted into the next shed by means of the insertion nozzle while the loop is undone at the same time.

In the apparatus in accordance with FIG. 4 the weft thread 1 is clamped and held by means of the thread clamp 42 so that, on the one hand, a thread loop forms between the feed-in nozzle 11 and the thread clamp 42 and, on the other hand, the thread end produced by means of the severing apparatus 5 is held stretched, i.e. taut and extended and ready for introduction into the weft thread distribution apparatus. The formation of a loop can be effected by means of an active or a passive deflection movement.

In the method a weft thread is continuously supplied by means of a fluid flow and inserted into successive sheds. Through reversal of the flow direction or deflection of the weft thread a thread loop is formed outside of the weft thread distribution apparatus, whereby the weft thread remains stretched inside the weft thread distribution apparatus.

A nozzle arrangement of which the flow direction is reversible is provided for carrying out the method.

What is claimed is:

1. A method for the insertion of a weft thread into a series shed weaving machine including a weft thread feed-in nozzle and a weft thread distribution apparatus located downstream from the feed-in nozzle in a weft thread movement direction, the method comprising the steps of forming a first fluid flow and therewith continuously feeding weft thread towards the distribution apparatus for insertion of the weft thread in successive sheds formed by the weaving machine, and, prior to a completion of the insertion of a weft thread in a shed, generating a reverse fluid flow outside the weft thread distribution apparatus and therewith forming a weft thread loop between the feed-in nozzle and the distribution apparatus and a substantially taut weft thread end portion which is ready for insertion into the distribution apparatus.

2. A method according to claim 1 wherein the step of forming the weft thread loop comprises forming a freely floating weft thread loop.

3. A method according to claim 1 including the step of forming at least one guided weft thread loop.

4. A method for the insertion of a weft thread into a series shed weaving machine including a weft thread feed-in nozzle and a weft thread distribution apparatus located downstream from the feed-in nozzle in a weft thread movement direction, the method comprising the steps of forming a fluid flow and therewith continuously feeding weft thread towards the distribution apparatus for insertion of the weft thread in successive sheds formed by the weaving machine, and, prior to a completion of the insertion of a weft thread in a shed, forming a substantially taut weft thread end portion which is ready for insertion into the distribution apparatus by clamping or deflecting the weft thread outside the distribution apparatus.

5. Apparatus for the insertion of a weft thread into a series shed weaving machine comprising a weft thread feed-in nozzle for continuously feeding weft thread in a downstream direction, a weft thread distribution apparatus downstream of the feed-in nozzle for inserting weft thread in successive sheds formed by the weaving machine, and a nozzle arrangement disposed between the feed-in nozzle and the weft distribution apparatus assisting movement of the weft thread during its insertion by the distribution apparatus and adapted to form a weft thread loop with weft thread fed from the feed-in nozzle upstream of the nozzle arrangement immediately after completing inserting a weft thread in a shed.

6. Apparatus according to claim 5 wherein the nozzle arrangement is further adapted to render a portion of the weft thread immediately upstream of the nozzle arrangement substantially taut.

7. Apparatus according to claim 6 wherein the nozzle arrangement includes means for generating a fluid flow in an upstream direction.

8. Apparatus according to claim 7 wherein the nozzle arrangement includes a valve for regulating the fluid flow in the nozzle arrangement.

9. Apparatus according to claim 8 wherein the valve is a rotatable disc valve.

10. Apparatus according to claim 7 including an auxiliary nozzle arranged upstream of the nozzle arrangement for generating a fluid flow assisting the formation of the weft thread loop.

11. Apparatus according to claim 5 including a guide for the weft thread arranged immediately downstream of the feed in nozzle.

12. Apparatus according to claim 5 including a weft thread insertion nozzle between the nozzle apparatus and the weft thread distribution arrangement.

13. Apparatus for the insertion of a weft thread into a series shed weaving machine comprising a weft thread feed-in nozzle for continuously feeding weft thread in a downstream direction, a weft thread insertion nozzle, a weft thread distribution apparatus for inserting weft thread in successive sheds formed by the weaving machine, and at least one of a weft thread clamp and a weft thread deflection member arranged upstream of the insertion nozzle for forming a weft thread loop upstream of the at least one of the clamp and the deflection member immediately after completion of inserting the weft thread.

14. Apparatus according to claim 13 comprising the weft thread clamp only and further including a thread guide member arranged upstream of the weft thread clamp in the path of a weft thread.

15. Apparatus according to claim 13 wherein the weft thread deflection member is arranged upstream of the weft thread clamp for assisting in the formation of the weft thread loop.

16. Apparatus according to claim 13 including a drive element for the deflection member.

17. Apparatus according to claim 13 wherein the weft thread clamp is integrated into the insertion nozzle.

18. A series shed weaving machine comprising a weft thread feed-in nozzle for continuously feeding weft thread in a downstream direction, a weft thread distribution apparatus downstream of the feed-in nozzle for inserting weft thread in successive sheds formed by the weaving machine, and a nozzle arrangement disposed between the feed-in nozzle and the weft distribution apparatus assisting movement of the weft thread during its insertion by the distribution apparatus and adapted to form a weft thread loop with weft thread fed from the feed-in nozzle upstream of the nozzle arrangement immediately after completing inserting a weft thread in a shed.

19. A series shed weaving machine comprising a weft thread feed-in nozzle for continuously feeding weft thread in a downstream direction, a weft thread insertion nozzle, a weft thread distribution apparatus for inserting weft thread in successive sheds formed by the weaving machine, and at least one of a weft thread clamp and a weft thread deflection member arranged upstream of the insertion nozzle for forming a weft thread loop upstream of the at least one of the clamp and the deflection member immediately after completion of inserting the weft thread.

* * * * *